US011804325B2

(12) United States Patent
Otani et al.

(10) Patent No.: US 11,804,325 B2
(45) Date of Patent: Oct. 31, 2023

(54) ELECTRONIC COMPONENT AND PRODUCTION METHOD THEREOF

(71) Applicant: Murata Manufacturing Co., Ltd., Kyoto-fu (JP)

(72) Inventors: Shinji Otani, Nagaokakyo (JP); Hiroki Imaeda, Nagaokakyo (JP); Namiko Sasajima, Nagaokakyo (JP); Tomohiro Sunaga, Nagaokakyo (JP); Masami Okado, Nagaokakyo (JP); Yoshimasa Yoshioka, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 387 days.

(21) Appl. No.: 16/995,103

(22) Filed: Aug. 17, 2020

(65) Prior Publication Data

US 2021/0065964 A1 Mar. 4, 2021

(30) Foreign Application Priority Data

Sep. 3, 2019 (JP) ..... 2019-160557

(51) Int. Cl.

| | |
|---|---|
| ***H01F 27/29*** | (2006.01) |
| ***H01F 27/28*** | (2006.01) |
| ***H01F 27/255*** | (2006.01) |
| ***H01F 41/02*** | (2006.01) |
| ***H01F 41/04*** | (2006.01) |

(52) U.S. Cl.

CPC ..... *H01F 27/2804* (2013.01); *H01F 27/255* (2013.01); *H01F 41/0246* (2013.01); *H01F 41/041* (2013.01); *H01F 2027/2809* (2013.01)

(58) Field of Classification Search

CPC ..... H01F 27/2804; H01F 27/255
USPC ..... 336/200
See application file for complete search history.

(56) References Cited

U.S. PATENT DOCUMENTS

| | | | | |
|---|---|---|---|---|
| 2004/0140022 | A1* | 7/2004 | Inohana | C22F 1/08 148/553 |
| 2013/0057375 | A1* | 3/2013 | Ankyu | C04B 35/6262 156/89.12 |
| 2016/0035476 | A1* | 2/2016 | Mimura | H01F 41/046 336/199 |
| 2017/0229221 | A1* | 8/2017 | Okada | H01F 27/2804 |
| 2020/0051728 | A1* | 2/2020 | Matsumoto | H01F 27/2804 |

FOREIGN PATENT DOCUMENTS

| | | | |
|---|---|---|---|
| CN | 101667484 | A | 3/2010 |
| CN | 107039144 | A | 8/2017 |
| JP | 2007-250787 | A | 9/2007 |
| JP | 2013-225718 | A | 10/2013 |
| JP | 2017-107971 | A | 6/2017 |

* cited by examiner

*Primary Examiner* — Ronald Hinson
(74) *Attorney, Agent, or Firm* — Studebaker & Brackett PC

(57) ABSTRACT

An electronic component includes a composite body composed of a composite material of a resin and a magnetic metal powder and a metal film disposed on an outer surface of the composite body. The magnetic metal powder contains Fe. The metal film mainly contains Cu, further contains Fe, and is in contact with the resin and the magnetic metal powder.

6 Claims, 4 Drawing Sheets

ELECTRONIC COMPONENT AND PRODUCTION METHOD THEREOF

CROSS-REFERENCE TO RELATED APPLICATION

This application claims benefit of priority to Japanese Patent Application No. 2019-160557, filed Sep. 3, 2019, the entire content of which is incorporated herein by reference.

BACKGROUND

Technical Field

The present disclosure relates to an electronic component and a production method thereof.

Background Art

Hitherto, an electronic component disclosed in Japanese Unexamined Patent Application Publication No. 2013-225718 has been known. The electronic component includes a composite body (an upper core and a lower core) composed of a composite material of a resin and a magnetic metal powder and metal films (terminal electrodes) disposed on an outer surface of the composite body. The magnetic metal powder contains Fe.

SUMMARY

In such an electronic component of the related art as described above, Cu, which is highly conductive, is used for the metal films. The coefficient of linear expansion of the magnetic metal powder containing Fe is significantly different from that of a metal film containing Cu. Thus, the adhesion between the magnetic metal powder and the metal film may be decreased under thermal loading.

The present disclosure provides an electronic component in which a decrease in adhesion between the magnetic metal powder and the metal film is suppressed under thermal loading, and which has improved reliability of the adhesion between a magnetic metal powder and a metal film and a method for producing the electronic component.

According to one embodiment of the present disclosure, an electronic component includes a composite body composed of a composite material of a resin and a magnetic metal powder and a metal film disposed on an outer surface of the composite body. The magnetic metal powder contains Fe, the metal film mainly contains Cu, further contains Fe, and is in contact with the magnetic metal powder.

The phrase "the metal film mainly containing Cu" indicates that the metal film has a Cu content of 95% or more by weight.

In this case, both of the magnetic metal powder and the metal film contain Fe; thus, the coefficient of linear expansion of the metal film can be close to the coefficient of linear expansion of the magnetic metal powder, thereby suppressing a decrease in adhesion between the magnetic metal powder and the metal film under thermal loading. This can lead to improved reliability of the adhesion between the magnetic metal powder and the metal film.

In the electronic component according to the embodiment of the present disclosure, the metal film may have an Fe content of about 0.01% or more by weight and about 2.6% or less by weight (i.e., from about 0.01% by weight to about 2.6% by weight) with respect to Cu.

In this case, since the Fe content is about 0.01% or more by weight with respect to Cu, the coefficient of linear expansion of the metal film can be reliably close to that of the magnetic metal powder. Since the Fe content is about 2.6% or less by weight with respect to Cu, increases in internal stress and electrical resistance can be suppressed.

In the electronic component according to the embodiment of the present disclosure, the metal film may further contain Ni.

In this case, since the metal film contains Ni, the coefficient of linear expansion of the metal film can be closer to that of the magnetic metal powder. It is thus possible to suppress a decrease in adhesion between the magnetic metal powder and the metal film under thermal loading.

The electronic component according to the embodiment of the present disclosure may further include an inductor line disposed in the composite body and extending parallel to the outer surface, a substantially columnar line extending from the inductor line in a direction perpendicular to the outer surface, penetrating through the composite body, and being exposed at the outer surface, and a cover film covering the metal film, in which the metal film is in contact with the substantially columnar line. Also, the metal film and the cover film are included in an external terminal.

In this case, it is possible to provide the electronic component having improved reliability of the adhesion between the composite body and the external terminal.

According to one embodiment of the present disclosure, a method for producing an electronic component includes forming a metal film on an outer surface of a composite body composed of a composite material of a resin and a magnetic metal powder by electroless plating treatment, in which the metal film mainly contains Cu and further contains Fe, and the metal film is deposited on the magnetic metal powder containing Fe by electroless plating treatment and is in contact with the resin.

In this case, the incorporation of Fe into both of the magnetic metal powder and the metal film enables the coefficient of linear expansion of the metal film to be close to the coefficient of linear expansion of the magnetic metal powder, thereby suppressing a decrease in adhesion between the magnetic metal powder and the metal film under thermal loading. This can lead to improved adhesion between the magnetic metal powder and the metal film.

Other features, elements, characteristics and advantages of the present disclosure will become more apparent from the following detailed description of the present disclosure with reference to the attached drawings.

DETAILED DESCRIPTION

An electronic component according to an embodiment of the present disclosure will be described in detail below with reference to the attached drawings. The drawings include some schematic ones and may not reflect actual dimensions or proportions.

First Embodiment

Configuration

Figure 1A:
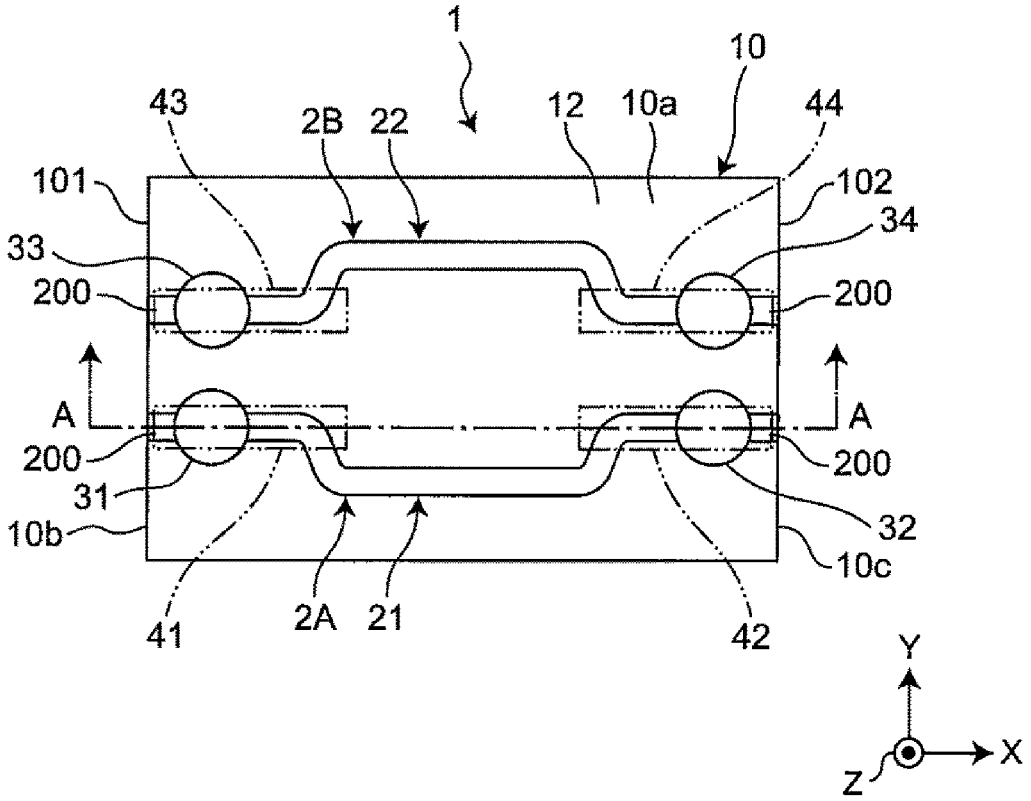
FIG. 1A is a perspective plan view of an inductor component as an electronic component according to a first embodiment.
Figure 1B:
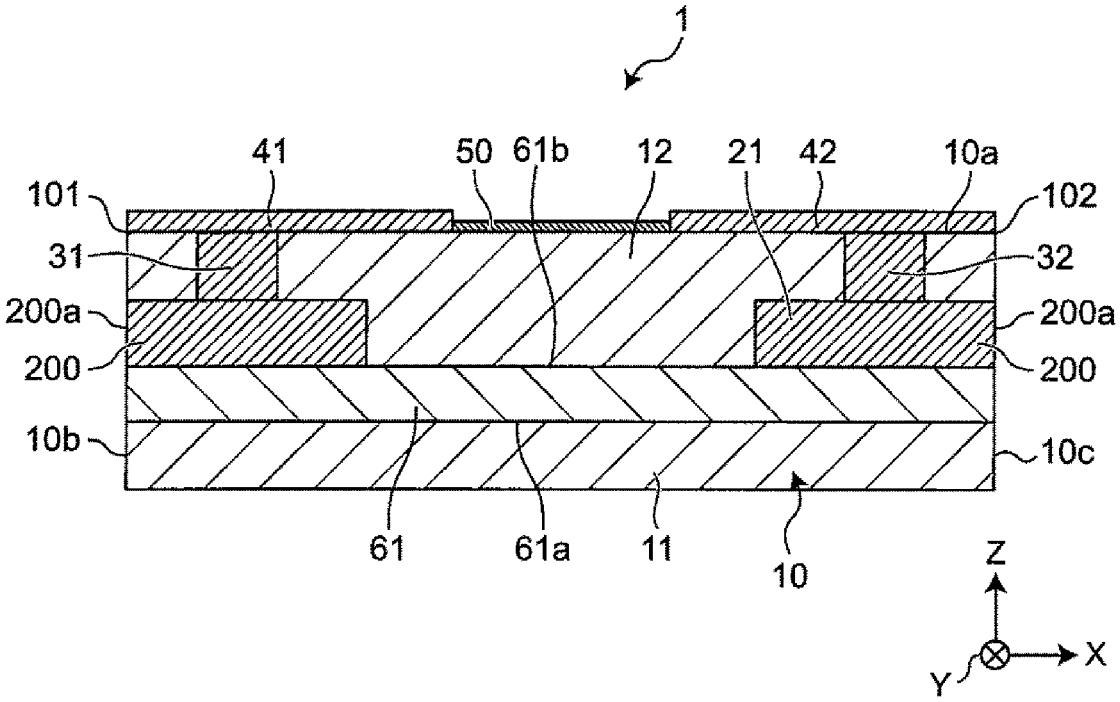
FIG. 1B is a cross-sectional view taken along line A-A of FIG. 1A.
Figure 2:
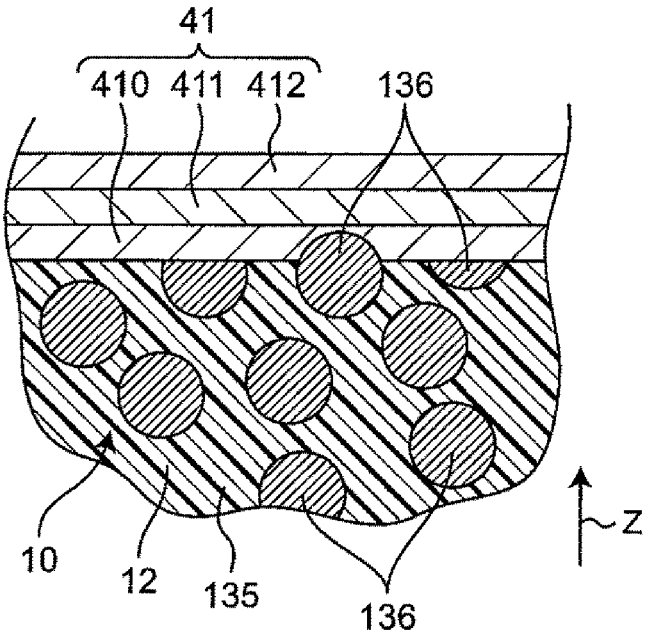
FIG. 2 is a partially enlarged view of FIG. 1B.

FIG. 1A is a perspective plan view of an electronic component according to a first embodiment. FIG. 1B is a cross-sectional view taken along line A-A of FIG. 1A. FIG. 2 is a partially enlarged view of FIG. 1B.

An example of the electronic component is an inductor component 1. The inductor component 1 is, for example, a surface-mount electronic component mounted on a circuit board installed in an electronic device such as a personal computer, a digital versatile disc (DVD) player, a digital camera, a television (TV) set, a cellular phone, or an automotive electronic system. The inductor component 1, however, may be an electronic component built in a substrate, instead of a surface-mount electronic component. The inductor component 1 is, for example, a substantially rectangular parallelepiped component as a whole. The shape of the inductor component 1 may be, but is not particularly limited to, a substantially cylindrical shape, a substantially polygonal columnar shape, a substantially truncated cone shape, or a substantially truncated polygonal pyramid shape.

As illustrated in FIGS. 1A and 1B, the inductor component 1 includes a base body 10 having insulating properties, a first inductor device 2A and a second inductor device 2B disposed in the base body 10, a first substantially columnar line 31, a second substantially columnar line 32, a third substantially columnar line 33, and a fourth substantially columnar line 34 that are buried in the base body 10, an end face of each of the first to fourth substantially columnar lines 31 to 34 being exposed at a substantially rectangular first main surface 10*a* of the base body 10, a first external terminal 41, a second external terminal 42, a third external terminal 43, and a fourth external terminal 44 that are disposed on the first main surface 10*a* of the base body 10, and an insulating film 50 disposed on the first main surface 10*a* of the base body 10. In the figure, a direction parallel to the thickness of the inductor component 1 is defined as a Z direction. The positive Z direction is defined as an upward direction. The negative Z direction is defined as a downward direction. In a plane perpendicular to the Z direction, a direction parallel to the direction of the length of the inductor component 1 is defined as an X direction, and a direction parallel to the direction of the width of the inductor component 1 is defined as a Y direction.

The base body 10 includes an insulating layer 61, a first magnetic layer 11 disposed on the lower surface 61*a* of the insulating layer 61, and a second magnetic layer 12 disposed on the upper surface 61*b* of the insulating layer 61. The first main surface 10*a* of the base body 10 corresponds to the upper surface of the second magnetic layer 12. The base body 10 has a three-layer structure including the insulating layer 61, the first magnetic layer 11, and the second magnetic layer 12. However, the base body 10 may have a single-layer structure consisting only of a magnetic layer, a two-layer structure consisting only of a magnetic layer and an insulating layer, or a four-or-more-layer structure consisting of multiple magnetic layers and an insulating layer.

The insulating layer 61 has insulating properties and is a layer having a substantially rectangular main surface. The insulating layer 61 has a thickness of, for example, about 10 μm or more and 100 μm or less (i.e., from about 10 μm to 100 μm). The insulating layer 61 is preferably, for example, an insulating resin layer composed of an epoxy-based resin or a polyimide-based resin containing no base material, such as glass cloth, from the viewpoint of reducing the profile. However, the insulating layer 61 may be a sintered layer composed of a magnetic material, such as NiZn- or MnZn-based ferrite, or a non-magnetic material, such as alumina or glass, or may be a resin substrate layer containing a base material, such as a glass-epoxy material. When the insulating layer 61 is a sintered layer, the insulating layer 61 has high strength and good flatness, thus improving the processability of a stacked material on the insulating layer 61. Additionally, when the insulating layer 61 is a sintered layer, the insulating layer 61 is preferably ground, in particular, is preferably ground from the undersurface on which no material is stacked, from the viewpoint of reducing the profile.

Each of the first magnetic layer 11 and the second magnetic layer 12 has high magnetic permeability, is a layer having a substantially rectangular main surface, and contains a resin 135 and a magnetic metal powder 136 in the resin 135. In other words, each of the first magnetic layer 11 and the second magnetic layer 12 is composed of a composite material of the resin 135 and the magnetic metal powder 136. The resin 135 is composed of an organic insulating material, such as epoxy-based resin, bismaleimide, a liquid crystal polymer, or polyimide. The magnetic metal powder 136 contains Fe and is composed of a magnetic metal material, such as an FeSi-based alloy, e.g., FeSiCr, an FeCo-based alloy, an Fe-based alloy, e.g., NiFe, or an amorphous alloy thereof. The magnetic metal powder 136 has an average particle size of, for example, about 0.1 μm or more and 5 μm or less (i.e., from about 0.1 μm to 5 μm). In a production process of the inductor component 1, the average particle size of the magnetic metal powder 136 can be calculated as a particle size (what is called "D50") corresponding to a 50% cumulative value in a particle size distribution determined by a laser diffraction/scattering method. The amount of the magnetic metal powder 136 contained is preferably about 20% or more by volume and about 70% or less by volume (i.e., from about 20% by volume to about 70% by volume) based on the entire magnetic layer. When the magnetic metal powder 136 has an average particle size of about 5 μm or less, the direct current superposition characteristics are further improved, and the use of the fine powder enables a reduction in iron loss at high frequencies. A magnetic powder composed of a NiZn- or MnZn-based ferrite may be used instead of the magnetic metal powder.

The first inductor device 2A and the second inductor device 2B include a first inductor line 21 and a second inductor line 22, respectively, disposed parallel to the first main surface 10*a* of the base body 10. Thus, the first inductor device 2A and the second inductor device 2B can be configured in a direction parallel to the first main surface 10*a* to enable a reduction in the profile of the inductor component 1. The first inductor line 21 and the second inductor line 22 are disposed on the same plane in the base body 10. Specifically, the first inductor line 21 and the second inductor line 22 are disposed only on the upper side of the insulating layer 61, i.e., the upper surface 61*b* of the insulating layer 61, and are covered with the second magnetic layer 12.

Each of the first and second inductor lines 21 and 22 is wound in a plane. Specifically, each of the first and second inductor lines 21 and 22 has a substantially semi-elliptical arc shape when viewed from the Z direction. That is, each of the first and second inductor lines 21 and 22 is a curved line wound about a half turn. Additionally, each of the first and second inductor lines 21 and 22 includes a straight portion in an intermediate section. In the present disclosure, the term "spiral" of each inductor line refers to a substantially curved shape including a substantially spiral shape wound in a plane and includes a substantially curved shape, such as the first inductor line 21 or the second inductor line 22, wound one turn or less. The substantially curved shape may partially include a substantially straight portion.

Each of the first and second inductor lines 21 and 22 preferably has a thickness of, for example, about 40 μm or more and about 120 μm or less (i.e., from about 40 μm to about 120 μm). In some embodiments, each of the first and second inductor lines 21 and 22 has a thickness of about 45 μm, a line width of about 40 μm, and a line spacing of about 10 μm. The line spacing is preferably about 3 μm or more and about 20 μm or less (i.e., from about 3 μm to about 20 μm) from the viewpoint of achieving good insulating properties.

Each of the first and second inductor lines 21 and 22 is composed of a conductive material and a low-electrical-resistance metal material, such as Cu, Ag, or Au. In this embodiment, the inductor component 1 includes only a single layer of the first and second inductor lines 21 and 22. This can achieve the low-profile inductor component 1. Each of the first and second inductor lines 21 and 22 may be formed of a metal film and may have a structure in which a conductive layer composed of, for example, Cu or Ag is disposed on an undercoat layer that is composed of, for example, Cu or Ti and that is deposited by electroless plating.

The first inductor line 21 has a first end portion and a second end portion that are electrically coupled to the first substantially columnar line 31 and the second substantially columnar line 32, respectively, located at outer side portions and is curved in an arc from the first substantially columnar line 31 and the second substantially columnar line 32 toward the center of the inductor component 1. The first inductor line 21 has pad portions having a larger line width than the substantially spiral shaped portion at both end portions thereof and is directly connected to the first and second substantially columnar lines 31 and 32 at the pad portions.

Similarly, the second inductor line 22 has a first end portion and a second end portion that are electrically coupled to the third substantially columnar line 33 and the fourth substantially columnar line 34, respectively, located at outer side portions and is curved in an arc from the third substantially columnar line 33 and the fourth substantially columnar line 34 toward the center of the inductor component 1.

Here, in each of the first and second inductor lines 21 and 22, a range surrounded by a curve of the first or second inductor line 21 or 22 and a straight line connecting both end portions of the first or second inductor line 21 or 22 is defined as an inside diameter portion. The inside diameter portions of the first and second inductor lines 21 and 22 do not overlap with each other, and the first and second inductor lines 21 and 22 are separated from each other, when viewed from the Z direction.

Lines extend in a direction parallel to the X direction from connection positions of the first and second inductor lines 21 and 22 and the first to fourth substantially columnar lines 31 to 34 and extend toward outer side portions of the inductor component 1. The lines are exposed at the outer side portions of the inductor component 1. That is, the first and second inductor lines 21 and 22 include exposed portions 200 each exposed to the outside at a side surface parallel to the stacking direction of the inductor component 1 (a plane parallel to the YZ plane).

The lines will be coupled to feeding lines when additional electroplating is performed after the formation of the shapes of the first and second inductor lines 21 and 22 in the production process of the inductor component 1. The use of the feeding lines enables easy implementation of additional electroplating in a state of an inductor substrate before the singulation of the inductor substrate into individual inductor components 1, thereby reducing the distance between the lines. The implementation of the additional electroplating can reduce the distance between the first and second inductor lines 21 and 22, thereby enhancing the magnetic coupling of the first and second inductor lines 21 and 22, increasing the line width of the first and second inductor lines 21 and 22 to reduce the electrical resistance, and reducing the size of the external form of the inductor component 1.

The first and second inductor lines 21 and 22 have the exposed portions 200 and thus can be highly resistant to electrostatic discharge damage during the processing of the inductor substrate. In each of the inductor lines 21 and 22, the thickness (a dimension in the Z direction) of the exposed surface 200*a* of each exposed portion 200 is preferably equal to or less than the thickness (a dimension in the Z direction) of the inductor lines 21 and 22 and about 45 μm or more. In the case where the thickness of the exposed surface 200*a* is equal to or less than the thickness of the inductor lines 21 and 22, the proportions of the magnetic layers 11 and 12 can be increased to improve the inductance. In the case where the thickness of the exposed surface 200*a* is about 45 μm or more, the occurrence of disconnection near the exposed surface 200*a* can be reduced. The exposed surface 200*a* is preferably formed of an oxide film. In this case, a short circuit can be suppressed between the inductor component 1 and its adjacent component.

The first to fourth substantially columnar lines 31 to 34 extend in the Z direction from the inductor lines 21 and 22 and penetrate through the second magnetic layer 12. The first substantially columnar line 31 extends upward from the upper surface of one end portion of the first inductor line 21. An end face of the first substantially columnar line 31 is exposed at the first main surface 10*a* of the base body 10. The second substantially columnar line 32 extends upward from the upper surface of the other end portion of the first inductor line 21. An end face of the second substantially columnar line 32 is exposed at the first main surface 10*a* of the base body 10. The third substantially columnar line 33 extends upward from the upper surface of one end portion of the second inductor line 22. An end face of the third substantially columnar line 33 is exposed at the first main surface 10*a* of the base body 10. The fourth substantially columnar line 34 extends upward from the upper surface of the other end portion of the second inductor line 22. An end face of the fourth substantially columnar line 34 is exposed at the first main surface 10*a* of the base body 10.

Accordingly, the first substantially columnar line 31, the second substantially columnar line 32, the third substantially columnar line 33, and the fourth substantially columnar line 34 extend linearly from the first inductor device 2A and the second inductor device 2B to the end faces exposed at the first main surface 10*a* in a direction perpendicular to the end faces. Thereby, the first external terminal 41, the second external terminal 42, the third external terminal 43, and the fourth external terminal 44 can be coupled to the first inductor device 2A and the second inductor device 2B at a shorter distance, thus enabling the inductor component 1 to have lower resistance and higher inductance. The first to fourth substantially columnar lines 31 to 34 are composed of a conductive material, such as the same material as that of the inductor lines 21 and 22.

The first to fourth external terminals 41 to 44 are disposed on the first main surface 10*a* of the base body 10. Each of the first to fourth external terminals 41 to 44 is formed of a metal film disposed on an outer surface of the second magnetic layer 12 (composite body). The first external terminal 41 is in contact with the end face of the first substantially columnar line 31 exposed at the first main surface 10*a* of the base body 10 and is electrically coupled to the first substantially columnar line 31. Thereby, the first external terminal 41 is electrically coupled to one end portion of the first inductor line 21. The second external terminal 42 is in contact with an end face of the second substantially columnar line 32 exposed at the first main surface 10*a* of the base body 10 and is electrically coupled to the second substantially columnar line 32. Thereby, the second external terminal 42 is electrically coupled to the other end portion of the first inductor line 21.

Similarly, the third external terminal 43 is in contact with the end face of the third substantially columnar line 33, is electrically coupled to the third substantially columnar line 33, and is electrically coupled to one end portion of the second inductor line 22. The fourth external terminal 44 is in contact with the end face of the fourth substantially columnar line 34, is electrically coupled to the fourth substantially columnar line 34, and is electrically coupled to the other end of the second inductor line 22.

The first main surface 10*a* of the inductor component 1 has a first end edge 101 and a second end edge 102 that extend linearly and that correspond to sides of a substantially rectangular shape. The first end edge 101 and the second end edge 102 are end edges of the first main surface 10*a* connected to a first side surface 10*b* and a second side surface 10*c*, respectively, of the base body 10. The first external terminal 41 and the third external terminal 43 are arranged along the first end edge 101 adjacent to the first side surface 10*b* of the base body 10. The second external terminal 42 and the fourth external terminal 44 are arranged along the second end edge 102 adjacent to the second side surface 10*c* of the base body 10. The first side surface 10*b* and the second side surface 10*c* of the base body 10 extend in the Y direction and coincide with the first end edge 101 and the second end edge 102, respectively, when viewed from a direction perpendicular to the first main surface 10*a* of the base body 10. The arrangement direction of the first external terminal 41 and the third external terminal 43 is a direction connecting the center of the first external terminal 41 and the center of the third external terminal 43. The arrangement direction of the second external terminal 42 and the fourth external terminal 44 is a direction connecting the center of the second external terminal 42 and the center of the fourth external terminal 44.

The insulating film 50 is disposed on a portion of the first main surface 10*a* of the base body 10 where the first to fourth external terminals 41 to 44 are not disposed. However, end portions of the first to fourth external terminals 41 to 44 may extend on portions of the insulating film 50, so that the portions of the insulating film 50 may overlap the end portions of the first to fourth external terminals 41 to 44 in the Z direction. The insulating film 50 is composed of, for example, a resin material, such as an acrylic resin, an epoxy-based resin, or polyimide, having high electrical insulating properties. This can lead to improved insulation among the first to fourth external terminals 41 to 44. The insulating film 50 serves as a mask used for the pattern formation of the first to fourth external terminals 41 to 44 to improve the production efficiency. When the magnetic metal powder 136 is exposed at a surface of the resin 135, the insulating film 50 can cover the exposed magnetic metal powder 136 to prevent the exposure of the magnetic metal powder 136 to the outside. The insulating film 50 may contain a filler composed of an insulating material, such as silica or barium sulfate.

As illustrated in FIG. 2, the first external terminal 41 is a multilayer metal film including three layers: a metal film 410, a first cover film 411 covering the metal film 410, and a second cover film 412 covering the first cover film 411, the metal film 410 being disposed on the second magnetic layer 12 and in contact with the resin 135 and the magnetic metal powder 136. The structures of the second, third, and fourth external terminals 42, 43, and 44 are the same as the structure of the first external terminal 41; thus, the first external terminal 41 alone will be described below.

The metal film 410 mainly contains Cu and further contains Fe. The metal film 410 is composed of a metal or an alloy containing Cu and Fe. In this case, both of the magnetic metal powder 136 and the metal film 410 contain Fe. This enables the coefficient of linear expansion of the metal film 410 to be close to that of the magnetic metal powder 136, can result in the suppression of a decrease in adhesion between the magnetic metal powder 136 and the metal film 410 under thermal loading, and can lead to improved reliability of the adhesion between the magnetic metal powder 136 and the metal film 410.

Additionally, since both of the magnetic metal powder 136 and the metal film 410 contain Fe, for example, Fe is incorporated into a Cu plating solution in advance, and the metal film 410 is formed by plating treatment with this plating solution. This makes it difficult for the magnetic metal powder 136 in the second magnetic layer 12 (composite body) to dissolve in the plating solution during the plating treatment, thus enabling the suppression of a decrease in the amount of the magnetic metal powder 136. That is, Fe contained in the plating solution is incorporated into the metal film 410. In addition, Fe that has been slightly leached from the second magnetic layer 12 may be incorporated into the metal film 410. Accordingly, a decrease in the amount of the magnetic metal powder can be suppressed to suppress the deterioration of the characteristics due to the magnetic metal powder. That is, it is possible to provide the inductor component 1 in which the deterioration of the characteristics, such as an L value, is suppressed.

The metal film 410 preferably has an Fe content of about 0.01% or more by weight and about 2.6% or less by weight (i.e., from about 0.01% by weight to about 2.6% by weight), more preferably about 0.01% or more by weight and about 0.28% or less (i.e., from about 0.01% by weight to about 0.28% by weight) with respect to Cu. In this case, since the Fe content with respect to Cu is about 0.01% or more by weight, the coefficient of linear expansion of the metal film 410 can be reliably close to that of the magnetic metal powder 136. Since the Fe content with respect to Cu is about 2.6% or less by weight, increases in internal stress and electrical resistance can be suppressed.

Preferably, the metal film 410 further contains Ni. The coefficient of linear expansion of Ni (about 13.3 [$\times 10^{-6}$/K]) is closer to the coefficient of linear expansion of Fe (about 11.7 [$\times 10^{-6}$/K]) than the coefficient of linear expansion of Cu (about 17.7 [$\times 10^{-6}$/K]). In this case, since the metal film 410 contains Ni, the coefficient of linear expansion of the metal film 410 can be close to that of the magnetic metal powder 136. This can suppress a decrease in adhesion between the magnetic metal powder 136 and the metal film 410 under thermal loading. Ni can be incorporated into the metal film 410 by the addition of, for example, a Rochelle salt- or EDTA-based complexing agent to the plating solution.

Each of the first cover film 411 and the second cover film 412 is a metal film covering the metal film 410. The first cover film 411 is a metal film directly covering the metal film 410 and composed of, for example, Ni. The first cover film 411 plays a role in suppressing the electrochemical migration and the solder leaching of the metal film 410.

The second cover film 412 is a metal film directly covering the first cover film 411, serves as the outermost layer of the first external terminal 41, and is composed of, for example, Au or Sn. The second cover film 412 acts to ensure the wettability.

Production Method

A method for producing the inductor component 1 will be described below.

Figure 3A:
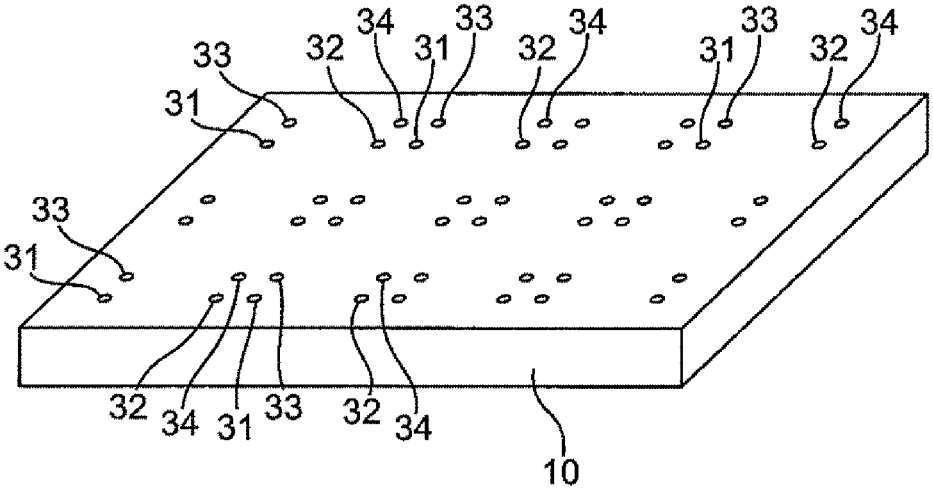
FIG. 3A is an explanatory view of a method for producing an inductor component.
Figure 3B:
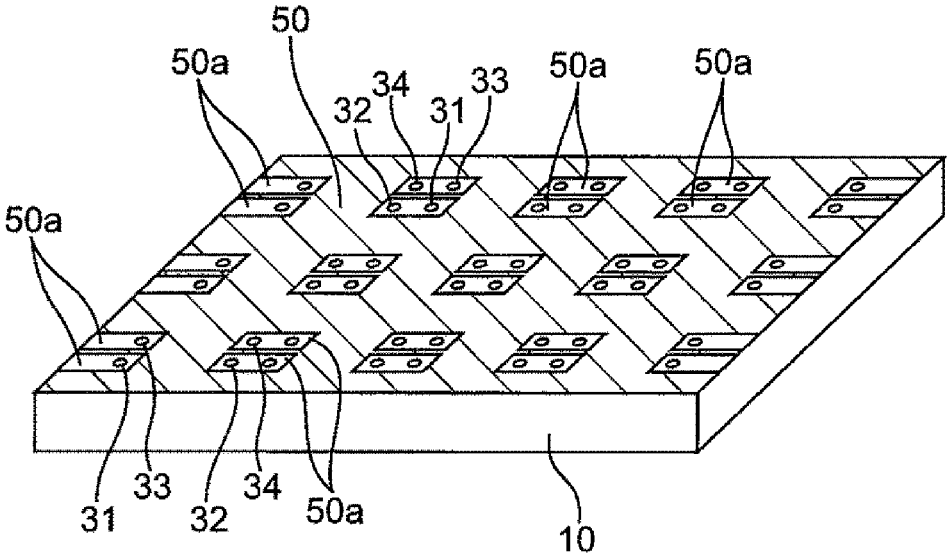
FIG. 3B is an explanatory view of the method for producing an inductor component.

As illustrated in FIG. 3A, the upper surface of the base body 10 is subjected to grinding processing such as grinding in a state in which the multiple inductor lines 21 and 22 and the multiple substantially columnar lines 31 to 34 are covered with the base body 10. Thereby, the end faces of the substantially columnar lines 31 to 34 are exposed at the upper surface of the base body 10. As illustrated in FIG. 3B, the insulating film 50 represented by a hatch pattern is then formed on the entire upper surface of the base body 10 by, for example, a coating method such as spin coating or screen printing, or a dry process such as the lamination of a dry film resist. The insulating film 50 is formed of, for example, a photosensitive resist.

Portions of the insulating film 50 in regions where external terminals are to be formed are removed by, for example, photolithography, laser processing, drilling, or blasting, so that through-holes 50*a* at which end faces of the substantially columnar lines 31 to 34 and part of the base body 10 (second magnetic layer 12) are exposed are formed in the insulating film 50. At this time, as illustrated in FIG. 3B, an end face of each of the substantially columnar lines 31 to 34 may be entirely or partially exposed at a corresponding one of the through-holes 50*a*. The end faces of the multiple substantially columnar lines 31 to 34 may be exposed at one of the through-holes 50*a*.

Figure 3C:
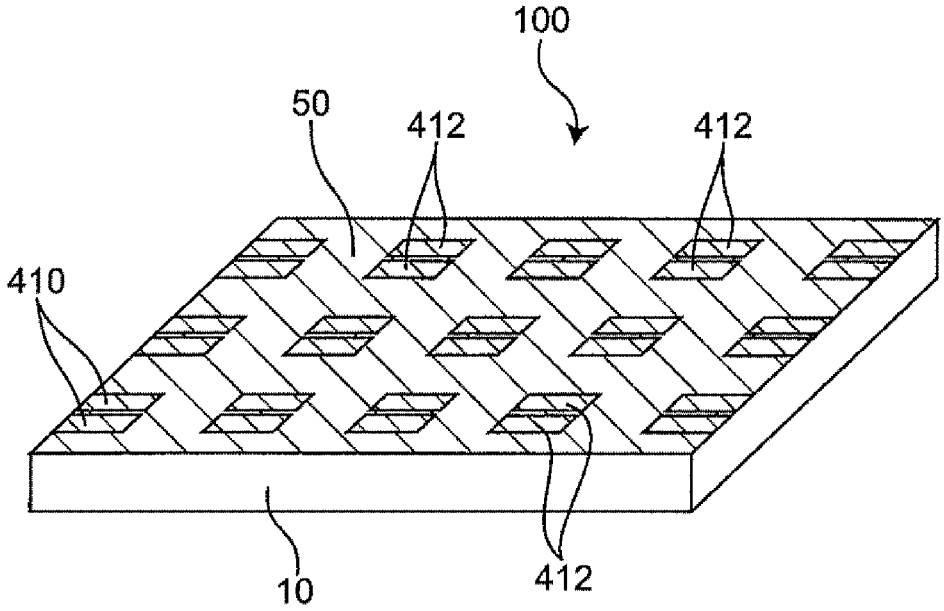
FIG. 3C is an explanatory view of the method for producing an inductor component.
Figure 3D:
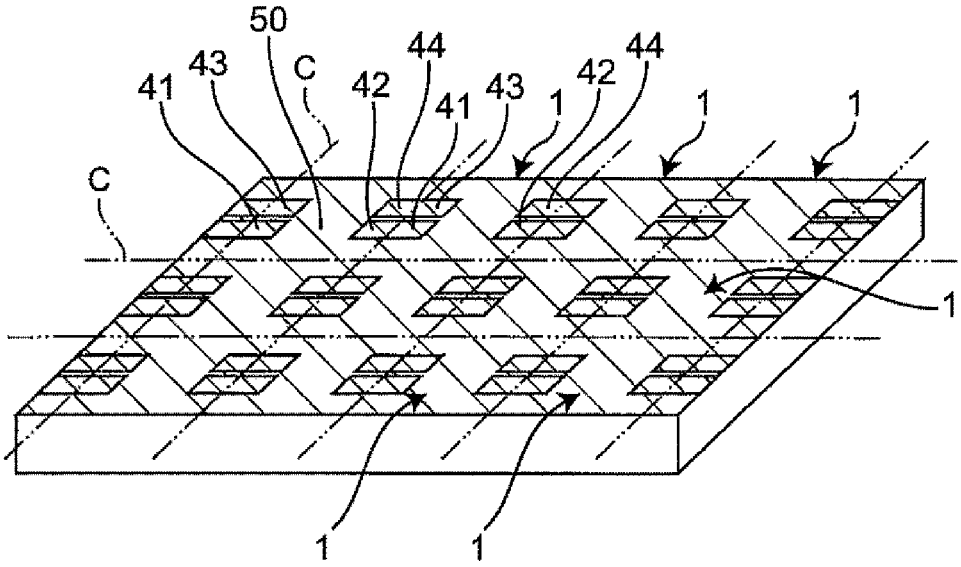
FIG. 3D is an explanatory view of the method for producing an inductor component.

As illustrated in FIG. 3C, the metal films 410 are formed in the through-holes 50*a* by a method described below. The first cover films 411 are formed on the metal films 410. The second cover films 412 represented by a hatch pattern are formed on the first cover films 411 to form a mother substrate 100. The metal films 410 and the cover films 411 and 412 constitute the external terminals 41 to 44 before cutting. As illustrated in FIG. 3D, the mother substrate 100, i.e., the sealed multiple inductor lines 21 and 22, is then cut along cut lines C with, for example, a dicing blade into pieces each including the two inductor lines 21 and 22, thereby producing the multiple inductor components 1. The metal films 410 and the cover films 411 and 412 are cut along cut lines C to form the external terminals 41 to 44. A method for producing the external terminals 41 to 44 may be a method in which the metal films 410 and the cover films 411 and 412 are cut as described above or may be a method in which the insulating film 50 is removed in advance in such a manner that the through-holes 50*a* have the shape of the external terminals 41 to 44, and then the metal films 410 and the cover films 411 and 412 are formed.

Method for Producing Metal Film 410

A method for producing the metal films 410 will be described below.

As described above, the end faces of the substantially columnar lines 31 to 34 and the base body 10 are exposed at the through-holes 50*a* when the through-holes 50*a* are formed in the insulating film 50. The end faces of the substantially columnar lines 31 to 34 and the upper surface of the base body 10 exposed at the through-holes 50*a* are subjected to electroless plating treatment to form Fe-containing Cu layers each serving as the metal film 410 that is in contact with the base body 10 and that is electrically conductive.

Specifically, each metal film 410 mainly containing Cu and further containing Fe is deposited on the magnetic metal powder 136 containing Fe by electroless plating treatment. For example, Fe is incorporated into a Cu plating solution in advance. The base body 10 is subjected to electroless plating treatment by immersing the base body 10 in the plating solution, thereby forming Fe-containing layers of electroless Cu plating as the metal films 410 on the second magnetic layer 12 (composite body). The metal films 410 are in contact with the resin 135 and the magnetic metal powder 136 in the second magnetic layer 12.

To form the metal films 410 on the substantially columnar (Cu) lines 31 to 34, for example, the metal films 410 deposited on the magnetic metal powder 136 may be allowed to grow to extend over the substantially columnar lines 31 to 34. Alternatively, Pd layers may be formed as catalyst layers on the substantially columnar lines 31 to 34, and then the metal films 410 may be formed on the Pd layers by electroless plating treatment.

The Fe content of each metal film 410 with respect to Cu can be adjusted by changing an Fe concentration in the plating solution. For example, when the plating solution used has an Fe concentration of 10 ppm, the Fe content is 0.28%. When the plating solution used has an Fe concentration of 106 ppm, the Fe content is 2.6%.

A method for incorporating Fe into the metal films 410 is not limited to the above-described method in which Fe is incorporated into the plating solution. For example, in the case where a decrease in the amount of the magnetic metal powder 136 is allowed, the magnetic metal powder 136 may be dissolved in the plating solution. Alternatively, a small amount of Fe may be incorporated into a target used for, for example, sputtering.

The present disclosure is not limited to the foregoing embodiment, and can be changed in design without departing from the scope of the present disclosure.

In the foregoing embodiment, two inductor devices, i.e., the first inductor device and the second inductor device, are arranged in the base body. However, three or more inductor devices may be arranged. In this case, six or more external terminals and six or more substantially columnar lines are arranged.

In the foregoing embodiment, the number of turns of the inductor line of each of the inductor devices is less than about one. However, the inductor line may be a curved line in which the number of turns of the inductor line is more than about one. The number of layers of the inductor lines in the inductor device is not limited to one, and a multilayer structure including two or more layers may be used. The arrangement of the first inductor line of the first inductor device and the second inductor line of the second inductor device is not limited to the configuration in which the first and second inductor lines are arranged on the same plane parallel to the first main surface and may be a configuration in which the first and second inductor lines are arranged in a direction perpendicular to the first main surface.

The "inductor line" produces magnetic flux at the magnetic layer when a current flows, thereby imparting inductance to the inductor component. The structure, shape, material, and so forth thereof are not particularly limited. For example, various known shaped lines, such as meander-shaped lines, may be used.

In the foregoing embodiment, the metal films are used as the external terminals of the inductor component. However, the metal films are not limited thereto. For example, the metal films may be used as internal electrodes of the inductor component. Additionally, the use of the metal films is not limited to the inductor component. The metal films may be used for other electronic components, such as capacitor components and resistor components, and may be used for circuit boards incorporating these electronic components. For example, the metal films may be used as line patterns of circuit boards.

In the foregoing embodiment, the metal films are used for the external terminals. However, the metal films may be used for the inductor lines. Specifically, the metal films may be formed on the composite body in place of a substrate by electroless plating treatment to form inductor lines. In this case, the metal films having the above-described effects can be obtained as the inductor lines, and the metal films can be formed so as to have the effects.

While some embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An electronic component, comprising:

a composite body composed of a composite material of a resin and a magnetic metal powder; and a metal film disposed on an outer surface of the composite body, the magnetic metal powder containing Fe, the metal film containing Cu in an amount of 95% by weight or greater, further containing Fe, and being in contact with the magnetic metal powder, wherein the metal film has an Fe content of from about 0.01% by weight to about 2.6% by weight with respect to Cu.

2. The electronic component according to claim 1, further comprising:

an inductor line disposed in the composite body and extending parallel to the outer surface;

a substantially columnar line extending from the inductor line in a direction perpendicular to the outer surface, penetrating through the composite body, and being exposed at the outer surface; and a cover film covering the metal film, wherein the metal film is in contact with the substantially columnar line, and the metal film and the cover film are included in an external terminal.

3. The electronic component according to claim 1, further comprising:

an inductor line disposed in the composite body and extending parallel to the outer surface; a substantially columnar line extending from the inductor line in a direction perpendicular to the outer surface, penetrating through the composite body, and being exposed at the outer surface; and a cover film covering the metal film, wherein the metal film is in contact with the substantially columnar line, and the metal film and the cover film are included in an external terminal.

4. The electronic component according to claim 1, wherein the metal film further contains Ni.

5. The electronic component according to claim 4, further comprising:

an inductor line disposed in the composite body and extending parallel to the outer surface;

a substantially columnar line extending from the inductor line in a direction perpendicular to the outer surface, penetrating through the composite body, and being exposed at the outer surface; and a cover film covering the metal film, wherein the metal film is in contact with the substantially columnar line, and the metal film and the cover film are included in an external terminal.

6. A method for producing an electronic component according to claim 1, the method comprising:

forming a metal film on an outer surface of a composite body by electroless plating treatment, wherein the metal film is deposited on the magnetic metal powder containing Fe by an electroless plating treatment and is in contact with the resin.

* * * * *